US006729505B2

(12) United States Patent
Ramsey et al.

(10) Patent No.: US 6,729,505 B2
(45) Date of Patent: May 4, 2004

(54) DISPENSING PUMP

(75) Inventors: Christopher Paul Ramsey, Wantage (GB); Martin John Watson, Wantage (GB); Reinhold Karl Jaeger-Waldau, Zell (DE)

(73) Assignee: Crown Cork & Seal Technologies Corporation, Alsip, IL (US)

( * ) Notice: Subject to any disclaimer, the term of this patent is extended or adjusted under 35 U.S.C. 154(b) by 0 days.

(21) Appl. No.: 10/240,153

(22) PCT Filed: Apr. 27, 2001

(86) PCT No.: PCT/EP01/04755

§ 371 (c)(1),
(2), (4) Date: Sep. 30, 2002

(87) PCT Pub. No.: WO01/87494

PCT Pub. Date: Nov. 22, 2001

(65) Prior Publication Data

US 2003/0047571 A1 Mar. 13, 2003

(30) Foreign Application Priority Data

May 11, 2000 (EP) ..... 00303981

(51) Int. Cl.[7] ..... B65D 88/54
(52) U.S. Cl. ..... 222/321.9; 222/341
(58) Field of Search ..... 222/321.9, 341, 222/153.13

(56) References Cited

U.S. PATENT DOCUMENTS 3,954,354 A * 5/1976 Boris ..... 222/321.9
5,462,208 A * 10/1995 Stahley et al. ..... 222/321.9
5,651,480 A * 7/1997 Piepenstock ..... 222/341
6,006,949 A * 12/1999 Foster et al. ..... 222/321.9

* cited by examiner

*Primary Examiner*—Philippe Derakshani
(74) *Attorney, Agent, or Firm*—Diller, Ramik & Wight

(57) ABSTRACT

A dispensing pump for liquid or pasty products comprising a housing (2), a piston (6) arranged to move telescopically within the housing between rest and activated positions and a plastics spring (9) arranged to return the piston from its activated to its rest position. The plastics spring has a folded, concertina configuration to provide the required return force for the piston. The spring also has end plates (91, 92), which can be adapted increased functionality. The whole pump may be moulded from a plastics material and has few component parts.

11 Claims, 3 Drawing Sheets

PRIOR ART

DISPENSING PUMP

BACKGROUND OF THE INVENTION

The present invention relates to a manually operated dispensing pump for a container, such as those used to dispense liquid or pasty products, like liquid soap, hand cream or foodstuffs like ketchup and sauces. In particular, the invention provides a low cost dispensing pump, which is economical to manufacture and easy to assemble. All the pump components may be moulded from a plastics material, using conventional injection or compression moulding techniques, for example.

Conventional dispensing pumps comprise a main body, which defines a pump chamber and is held captive in the neck of a container by a collar. A piston is arranged to move telescopically within the pump chamber between a rest position and an activated position. The free end of the piston (exposed outside the pump chamber) engages with a separate spout. The piston has a central dispensing passageway, which connects with the dispensing passageway through the spout. A helical spring is provided in the pump chamber to return the piston (and hence the spout) to its rest position after dispensing. Finally, the pump comprises an inlet valve in the pump chamber and an outlet valve in the dispensing passageway in the piston. The inlet valve allows product flow from the container into the pump chamber but prevents return flow from the pump chamber into the container. The outlet valve allows product to flow from the pump chamber through the spout but prevents return flow of product or air into the pump chamber.

In the simplest conventional dispensing pumps, the inlet valve comprises a ball bearing, which engages in a seat around the inlet to the pump chamber from the container. When a partial vacuum is formed in the pump chamber, by the action of the piston, product is drawn into the pump chamber from the container, lifting the ball bearing off the valve seat. The ball bearing is retained adjacent to the valve seat by one end of the helical spring and is constrained to move within the helical windings thereof. The helical spring has a tapering cross section, to limit the extent to which the ball bearing can lift off the valve seat.

The outlet valve is provided by another ball bearing, which engages in a valve seat defined in the dispensing passageway in the piston. The ball bearing is inserted into the dispensing passageway in the piston before the spout is assembled thereto and is then retained in the piston dispensing passageway by the spout. The spout is provided with engagement means for connecting it to the piston, and is adapted to constrain the ball bearing within the piston dispensing passageway. As the product is forced out of the pump chamber, the outlet valve ball bearing lifts off its valve seat, allowing product to pass through the dispensing passageway to the spout, where it is dispensed to the user. When product is drawn into the pump chamber from the container by the partial vacuum in the pump chamber, the outlet valve ball bearing is forced back against its valve seat, preventing air or any product remaining in the spout from being drawn back into the pump chamber.

Dispensing pumps according to the prior art may also include a locking arrangement to hold the spout/piston in a fixed position and thereby prevent accidental operation of the pump. The locking mechanism may be arranged to lock the spout/piston in its activated or rest position. For example, the spout and collar may be provided with mutually co-operating screw threads, which allow the user to lock the spout in its depressed position, when the pump is not in use.

As can be appreciated from the foregoing description, even the simplest conventional dispensing pumps have a number of components, which have to be assembled prior to fitting the pump on a filled container. In the dispensing pumps known from the prior art, the helical spring is normally made of metal because of its superior compression modulus. This is required to produce a compact spring, which has sufficient inherent strength to return the piston from its activated to its rest position. The metal, helical spring is normally bought in from a third party.

During assembly of the conventional dispensing pump, the spring is free to "float" within the pump chamber. This can lead to misalignment of the spring within the pump chamber, causing unsatisfactory operation of the pump. Furthermore, as described above, in some conventional dispensing pumps, the ball bearing forming part of the outlet valve is constrained within the windings of the helical spring. In such designs, it is important that the spring traps the ball bearing but is sized such that the ball bearing can move away from the valve seat. Misalignment of the helical spring in such designs may cause unsatisfactory operation of the inlet valve and hence the pump.

SUMMARY OF THE INVENTION

The aim of the present invention is to provide a dispensing pump having few parts, which is easy to assemble, and may be entirely moulded from a plastics material. This enables the pump manufacturer to manufacture all the parts of the pump, without relying on an external source for some of the components, such as the helical spring and ball bearings for example. However, in some circumstances, metal ball bearings may be retained, because their relative abundance makes it uneconomic to mould plastic equivalents. Furthermore, metal ball bearings are easier to handle than plastic equivalents, because they are heavier and are not prone to the build up of static electricity. In particular, an aim of the present invention is to provide a plastics spring which is compact, but which still has sufficient force to return the piston/spout from its activated to its rest position.

Accordingly, the present invention provides a dispensing pump for a container, the pump comprising a housing, held fixed in relation to the container and defining a pump chamber in communication with the inside of the container; a spout, arranged to move telescopically with respect to the housing between a rest position and an activated position; a spring, arranged to return the spout from its activated position to its rest position; an inlet valve, adapted to prevent air entering the container but to allow product to enter the pump chamber from the container; and an outlet valve, adapted to prevent air entering the pump chamber but to allow product to be dispensed from the pump chamber through the spout, characterised in that the spring is made from a plastics material and has a folded configuration, having a plurality of folds.

The dispensing pump according to the invention has a plastic spring instead of the metal helical spring conventionally used in the prior art. The advantage of using a plastic spring is that it can be moulded by the manufacturer of the pump, along with the body and spout and can be adapted to provide greater functionality than the conventional metal helical spring. However, the disadvantage of making the spring from a plastics material is that plastic has a very poor compression modulus compared to metal and therefore, the spring tends to be very weak. Thus, a plastic helical spring capable of returning the spout to its rest position would have to be much larger than its metal counterpart. For this reason, it is not feasible to merely change the material from which the spring is made. In order to produce a satisfactory plastic spring, the design of the spring has to be modified to enhance the strength of its return force.

Thus, one aim of the present invention is to provide a plastics spring which will fit in a conventional size pump chamber but which has sufficient inherent force to return the spout/piston to its rest position. The inventors have found that a spring having a folded configuration with a plurality of folds has sufficient inherent resilience for this task. This spring configuration can be easily moulded using conventional techniques and is compact enough to fit in a pump chamber of conventional size.

An advantage of this configuration is that radial deflection of the spring under compression is minimised, thereby ensuring that the spring does not bind against the side-walls of the pump chamber as it is compressed. Another advantage of the folded plastic spring configuration is that it has end plates at each end of the spring. These end plates may be adapted to provide the spring with greater functionality. For example, the end plates may be adapted to constrain the inlet valve, outlet valve or both within their respective housings. The end plate may even be adapted to provide a valve seat in which a valve member can rest to prevent flow through the valve in one direction.

Where the valve comprises a valve member, arranged to seat against a surface provided in the housing, the housing may be adapted to define a valve chamber within which the valve member is constrained to move. The end plate of the spring may then be used to define the end wall of the valve chamber. The valve member is allowed to float freely within the confines of the valve chamber, which can be designed for efficient operation of the valve. In some prior art designs, where a valve member is constrained to move within the confines of the windings of the helical spring, the valve member may operate less efficiently, causing unsatisfactory operation of the pump. If the valve member is allowed too much travel away from the valve seat, the valve will be difficult or impossible to prime. If the valve member is allowed insufficient travel, the valve may jam or fail to pump. Provision of a separate valve chamber allows the movement of the valve member to be more closely controlled. this arrangement allows the designer the freedom to provide a valve member that is not spherical. One end of the valve chamber preferably has an opening, which is sized to allow the valve member to be easily inserted into the chamber. The spring is inserted into the pump chamber and its end plate is arranged to close the opening in the valve chamber, holding the valve member captive therein.

Preferably, the body of the pump defines the valve chamber and the spout is adapted to provide a piston, which can move telescopically within the valve chamber. In the pump according to the invention, the piston and spout are formed integrally with one another. A tubular seal may be provided inside the piston portion of the spout. The seal may be adapted to define the valve seat for the outlet valve. Alternatively, the valve seat may be defined in the end plate of the plastic spring. The tubular seal is designed to extend below the free edge of the piston and flares radially outwardly to provide a seal against the side wall of the pump chamber. Preferably, the tubular seal is made from a more flexible material than the pump chamber. This ensures that the flared skirt of the tubular seal, extending beyond the free edge of the piston, is able to conform to the surface of the pump chamber and form a good fluid seal therewith, even when the piston moves telescopically within the pump chamber.

The piston/spout may be provided with a locking arrangement, which locks the piston relative to the housing, thereby preventing accidental operation of the dispensing pump. According to the invention, the locking arrangement is arranged to lock the piston in its rest position, with the spring substantially unstressed. This reduces the effects of creep in the plastic spring. When a plastic component is left for a prolonged period under load, the plastic material tends to undergo permanent deformation or creep, which would effect the behaviour of the plastic spring and hence its performance.

The present invention will now be described, by way of example only, with reference to the accompanying drawings, in which:

BRIEF DESCRIPTION OF THE DRAWINGS

Wherever possible, like components in the drawings have been given the same reference numerals.

DESCRIPTION OF THE PREFERRED EMBODIMENTS

Figure 1:
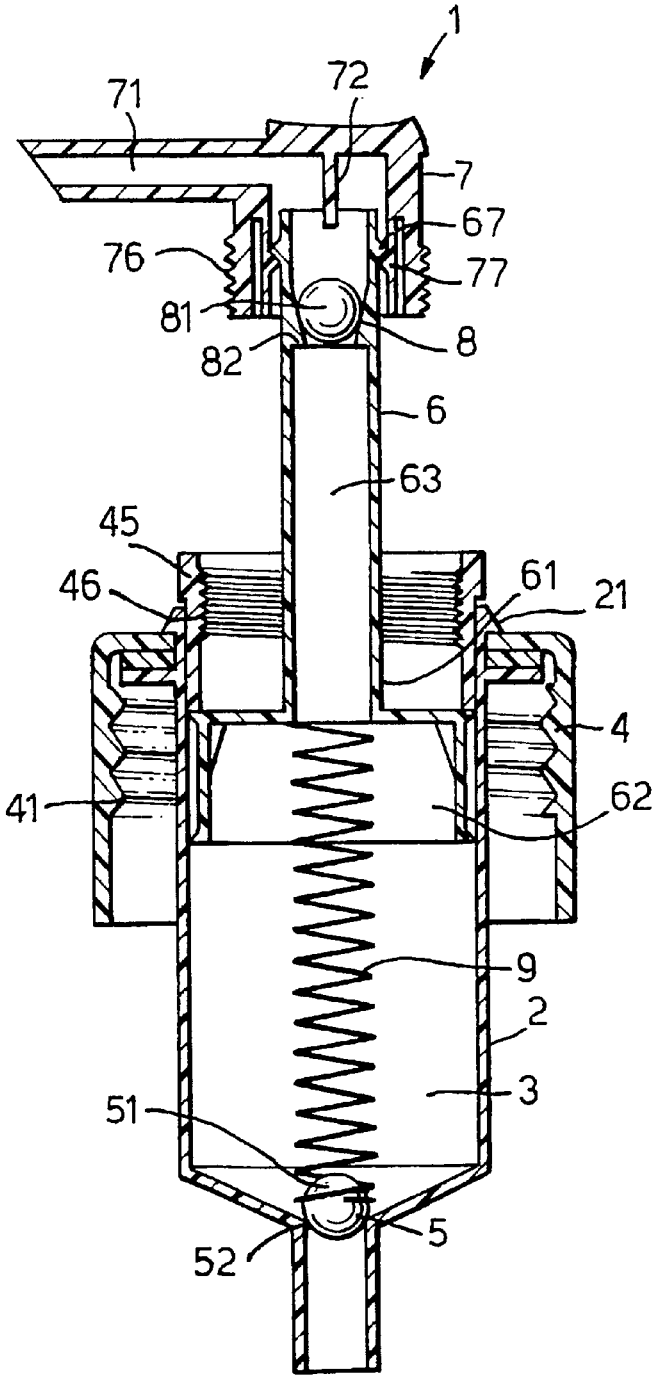
FIG. 1 shows a side section view of a conventional dispensing pump according to the prior art.

Referring to FIG. 1, a conventional dispensing pump 1 comprises a main body 2, which defines a pump chamber 3. The main body 2 is held fixed in the neck of a container (not shown) by a collar 4. The collar 4 may have a screw thread 41, which is adapted to engage with a complimentary screw thread on the container. At the base of the pump chamber 3, directed towards the inside of the container, the body 2 defines a valve seat 52 for an inlet valve 5. A ball bearing 51, which may be made of metal or a plastics material, seats against the valve seat 52 to prevent air or product entering the container from the valve chamber 3.

A piston 6 is arranged to move telescopically within the valve chamber 3 and comprises a piston portion 61, which is adapted to seal against the walls of the pump chamber, and a stem 62 which is adapted to connect with a separate spout 7. The piston 6 is retained in the main body 2 by a flange 45, which is adapted to fit into the open end of the body 2 and has orifices which are arranged to snap over ribs 21 projecting vertically from the body 2. The spout 7 and collar 4 may be provided with mutually co-operating screw threads 76, 46, which allow the spout to be locked in its depressed position, thereby preventing accidental operation of the pump.

The piston 6 has a central dispensing passageway 63, which extends from the valve chamber 3 at one end to the dispensing passageway 71 in the spout 7 at the other end.

Another valve seat 82 for an outlet valve 8, is defined in the dispensing passageway 63. A second ball bearing 81 seats against the valve seat 82, to prevent air being drawn into the pump chamber 3 under the action of the partial vacuum therein. The spout 7 has a projection 72, which extends into the dispensing passageway 63 in the piston 6 and prevents the ball bearing 81 being forced into the dispensing passageway 71 in the spout 7, as product is ejected from the spout 7.

Finally, the dispensing pump includes a helical spring 9, which extends the length of the pump chamber 3, when it is in its extended configuration. The spring 9 is adapted to restrict the movement of the inlet valve ball bearing 51, within its windings. The windings of the helical spring 9 gradually reduce in diameter away from the valve seat and thereby define a volume within which the ball bearing 51 can move and lift off the valve seat 52. The windings prevent the ball bearing 51 floating freely around the pump chamber 3 as product is drawn into the chamber through the inlet valve 5. As shown in FIG. 1, the spring 9 tapers towards its centre and widens towards both ends. Thus, the spring 9 has a symmetrical shape and can be assembled in the pump chamber 3 either way up.

To assemble the pump, the ball bearing 51 is dropped into the pump chamber 3, where it falls (under gravity) to seat against the valve seat 52. The helical spring 9 is then dropped into the pump chamber 3 so that one end surrounds the ball bearing 51. The ball bearing 81 is dropped into the dispensing passageway 63, through the open end of the piston stem 62, and drops (under gravity) to seat against the valve seat 82. The spout 7 is then connected to the free end of the piston stem 62 by means of the snap engagement beads 67, 77 and the projection 72 prevents the ball bearing 81 entering the dispensing passageway 71 in the spout 7. The piston 6 is inserted into the pump chamber 3, where the piston portion 61 seals against the side wall of the pump chamber 3 and the planar end wall of the piston portion 61 rests on the free end of the helical spring 9. The flange 45 is then snapped over the projecting ribs 21, securing the piston portion 62 within the pump chamber 3. The whole assembly may then be clipped into the collar 4 and fixed to a container.

In use, a user first depresses the spout 7, against the force of the spring 9 to prime the pump 1. The inlet valve 5 prevents any air in the pump chamber 3 being forced into the container. Instead, any air in the pump chamber is forced out of the spout past the outlet valve 8. The user then releases the spout 7 and the spring 9 returns the piston 6 (and hence spout 7) to its raised, "rest" position, drawing a partial vacuum in the pump chamber 3. The partial vacuum draws product from the container, through the inlet valve 5 and into the pump chamber 3. The ball bearing 51 lifts off the valve seat 52 as the product is drawn into the pump chamber 3, but its axial movement is restricted by the narrowed section in the windings of the helical spring 9. The outlet valve 8 prevents air being drawn into the pump chamber through the spout 7, under the influence of the partial vacuum in the pump chamber 3. The spout 7 may have to be depressed several times by the user, in order to prime the pump. Once the pump is primed, the pump chamber 3 is substantially filled with product and the air has been expelled from the spout 7.

When the spout 7 is next depressed by the user, the product in the pump chamber 3 is forced out through the dispensing passageway 63, 71 in the piston 6 and spout 7, past the outlet valve 8. The ball bearing 81 lifts off the valve seat 82, allowing the product to pass through the dispensing passageway 63 in the piston 6. The inlet valve 5 prevents the product from passing back into the container from the pump chamber 3. Again the user releases the spout 7, the spring 9 returns the spout 7 to its raised, "rest" position and more product is drawn into the pump chamber through the inlet valve 5, to replace that which has been dispensed from the spout 7.

Figure 2:
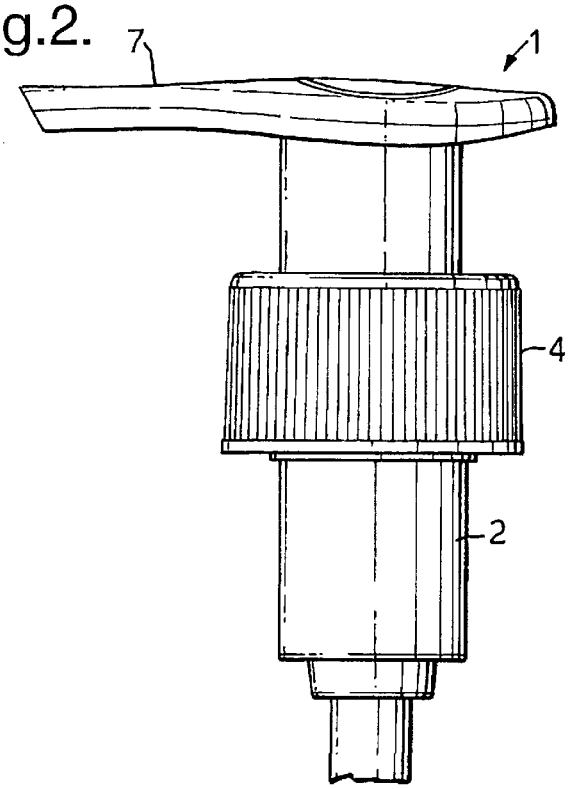
FIG. 2 shows an external side view of the dispensing pump according to the invention.
Figure 3:
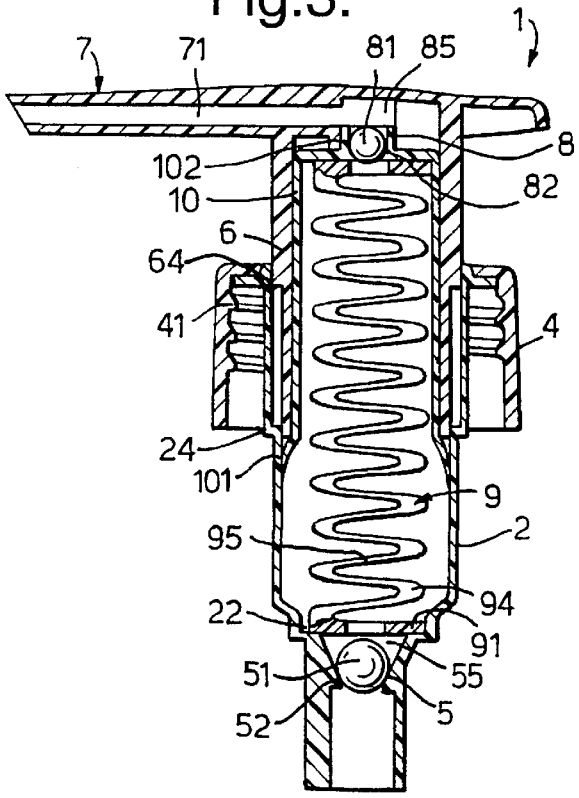
FIG. 3 shows a side section view of the dispensing pump according to the invention.

Referring to FIGS. 2 and 3, the dispensing pump 1 according to the invention also comprises a body 2, a spout 7 and a collar 4 for connecting the pump 1 to a container (not shown). Inside, the pump comprises an inlet valve 5, an outlet valve 8 and a spring 9, to return the spout 7 to is rest position after operation of the pump. The spring 9 is made from a plastics material and has a folded, concertina configuration. Each end of the spring has a planar end plate 91, 92 (see FIG. 4). The body 2 defines an inlet valve chamber 55 with a valve seat 52. A valve member 51, in the form of a ball bearing, is located in the valve chamber 55. The end plate 91 of the spring 9 occludes the open end of the valve chamber 55 and constrains the valve member 51 therein. The end plate 91 is adapted to form a force fit in a rim 22 around the periphery of the opening to the valve chamber 55. The rim 22 has a circular shape enabling the square end plate 91 of the spring 9, to snap into the rim 22, regardless of its orientation. This snap fit engagement ensures that the spring 9 is positively engaged in an upright position within the pump chamber 3 and prevents misalignment of the spring 9.

The spout 7 and piston 6 are formed integrally, as a single component. Preferably, a separate tubular seal 10 is arranged inside the piston 6. The seal 10 press fits inside the piston 6 and provides a seal between the moving piston 6 and the side wall of the pump chamber 3. It also defines a valve seat 82 for the outlet valve 8. The tubular seal 10 has a flexible skirt 101, which extends below the free end of the piston 6 and flares radially outwardly, to conform to the side wall of the pump chamber 3 and form a fluid seal therewith. The tubular seal 10 also comprises a chimney 102 adjacent to the valve seat 82, which extends into the dispensing passageway 71 in the spout 7 and constrains a second valve member 81 within the outlet valve chamber 85, defined in the spout 7.

The dispensing pump is operated in the same manner as previously described with respect to the prior art. However, the pump is particularly easy to assemble as all the components positively engage with one another. First the valve member 51 is dropped into the pump chamber 3 and falls (under gravity) into the valve chamber 55. Next the spring 9 is inserted into the pump chamber 3 and the end plate 91, positively engages in the rim 22, defined in the pump body 2, irrespective of its orientation. The positive engagement between the end plate 91 and the body 2, ensures that the spring 9 is arranged coaxially within the body 2. The valve member 81 is dropped into the chimney 102 of the tubular seal 10, which is then inserted into the piston 6. The chimney 102 engages in the valve chamber 85, and the spout 7 constrains the valve member 81 therein. Finally, the spout assembly 6, 7, 10 is inserted into the body 2, over the spring 9, which is arranged to extend the length of the pump chamber 3. Preferably, the spring 9 is pre-compressed slightly in the assembled pump. This ensures that the spring 9 consistently returns the spout 7 to its "rest" position and does not become sluggish towards the end of its return stroke. The level of pre-compression must be balance between ensuring a positive end to the return stroke of the piston 6, without causing undesirable creep in the plastic spring 9.

Referring to FIG. 3, it is apparent that the piston 6 is hollow and therefore part of the volume of the pump chamber 3 is defined inside the piston 6. This arrangement is used to minimise the overall volume of the pump chamber 3 and thereby prevents the assembled pump becoming too long. The degree of axial compression of the spring 9 dictates the volume of product that will be dispensed from the pump chamber 3 for each stroke of the piston 6. However, unlike conventional, metal helical springs, the plastic spring 9 according to the invention cannot be compressed flat. Preferably, the axial compression of the spring 9 is limited in order to ensure that the elasticity of the spring is retained. Therefore, even in its compressed configuration, the spring 9 has a significant length, which results in a volume of the pump chamber 3, which cannot be expelled.

In order to minimise the total volume of the pump chamber 3, this "dead volume" is defined inside the cavity in the piston 6, rather than in the portion of the pump chamber defined by the body 2.

The user of the pump 1, depresses the spout 7 from its rest position (shown in FIG. 3) to its activated position, where the stop 64 on the external surface of the piston 6 engages against the stop 24 on the internal surface of the body 2 and/or the lower surface of the spout 7 engages against the upper surface of the collar 4. The plastic spring 9, is compressed substantially axially. When the user releases the spout 7, the spring 9 returns to its original, expanded configuration (shown in FIG. 3), returning the spout 7 to its rest position and drawing product into the pump chamber 3 from the container via the inlet valve 5.

Figure 4:
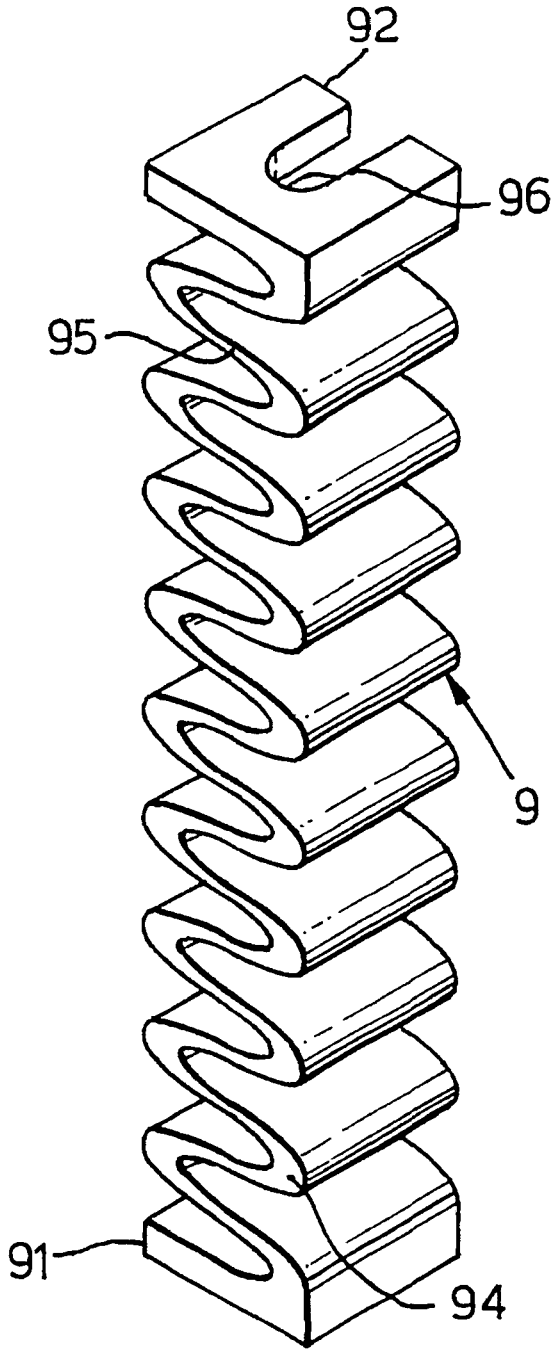
FIG. 4 shows an isometric view of the spring used in the dispensing pump according to the invention.

The spring 9 is shown more clearly in FIG. 4. Each end of the spring has an end plate 91, 92. Preferably, slots 96 are provided in the end plates 91, 92 to provide a flow path for the product. The spring configuration is symmetrical so that it can be inserted in the pump chamber 3 either way up i.e. with either end plate 91 or end plate 92 engaging in the rim 22 (shown in FIG. 3) and forming the end of the valve chamber 55.

From FIGS. 3 and 4, it is apparent that the folded spring is thicker at the folds 94 and thinner in the sections 95 between the folds 94. The folds 94 are made as thick as possible, because the ejector pins (for ejecting the spring 9 from the mould) are arranged to press against the folds 94. Preferably, as large ejector pins as possible are used, to prevent the pins pressing into the plastic material when ejecting the moulded spring 9. The thickness also varies across the width of the spring 9. This provides the spring with a draft, which allows it to be ejected from the mould.

Conveniently, a plurality of springs may be produced by extruding a sheet of plastic material having the required folded configuration and then cutting this sheet into sections. Alternatively, a sheet of plastic material may be folded into the required configuration and then cut into sections to provide a plurality of springs. The advantage of these methods is that a plurality of springs can be produced simply and cheaply. The resultant springs will also have a consistent thickness across their width and between the folds giving them more uniform properties.

Although the invention has been described for an arrangement where the spout forms a piston which moves telescopically within the body, it will be appreciated that the invention may equally be applied with the spout moving telescopically outside the body i.e. with the body effectively providing a fixed piston. It will also be appreciated that the collar is not essential as a means to connect the pump to the container. However, the advantage of providing a collar is that one size of dispensing pump can be used for a variety of containers having different sized necks.

From the foregoing, it will be apparent that any reduction in the dead volume within the pump chamber will make the pump easier and quicker to prime because there is less air in the chamber to be expelled before the pump can be used for the first time. Therefore, advantageously, the plastic spring may have a circular cross section, which corresponds to the circular section of the pump chamber. This minimises the dead volume around the sides of the spring and makes the pump easier to prime. Obviously, where the pump chamber has a non-circular cross section, the spring may be adapted to have a cross section which corresponds to that of the pump chamber. Many other adaptations of the plastic spring, particularly the configuration of its end plates, to provide greater functionality or improve the operation of the pump will be readily apparent to those skilled in the art.

Although a preferred embodiment of the invention has been specifically illustrated and described herein, it is to be understood that minor variations may be made in the apparatus without departing from the spirit and scope of the invention, as defined by the appended claims.

What is claimed is:

1. A dispensing pump for a container, the pump 1 comprising a housing 2, held fixed in relation to the container and defining a pump chamber 3 in communication with the inside of the container, a spout 7, arranged to move telescopically with respect to the housing 2 between a rest position and an activated position, a spring 9, arranged to return the spout 7 from its activated position to its rest position, an inlet valve 5, adapted to prevent air entering the container but to allow product to enter the pump chamber 3 from the container, and an outlet valve 8, adapted to prevent air entering the pump chamber but to allow product to be dispensed from the pump chamber through the spout, characterised in that the spring 9 is made from a plastics material and has a folded configuration, having a plurality of folds 94.

2. A dispensing pump according to claim 1, wherein the spring 9 has at least one end plate 91, 92, which is adapted to constrain at least one of the inlet valve 5 and outlet valve 8.

3. A dispensing pump according to claim 2, wherein at least one of the inlet valve 5 and outlet valve 8 comprises a valve member 51, 81, arranged to move within an associated valve chamber 55, 85 and the at least one end plate 91, 92 of the spring 9 is adapted to retain the valve member 51, 81 within the valve chamber 55, 85.

4. A dispensing pump according to claim 1, wherein the spout 7 has an integral piston portion 6, adapted to move telescopically within the housing 2.

5. A dispensing pump according to claim 4, wherein the spout 7 further comprises a tubular seal 10 adapted to fit inside the piston portion 6, the tubular seal 10 arranged to form a seal between the piston portion 6 and the pump chamber 3.

6. A dispensing pump according to claim 5, wherein the tubular seal 10 further defines a valve seat 82 within a valve chamber 85.

7. A dispensing pump according to claim 1, wherein the plastics spring 9 is manufactured by extruding a sheet having the required folded configuration and the sheet is then cut into segments to provide a plurality of springs.

8. A dispensing pump according to claim 1, wherein the plastics spring 9 has a cross section which conforms to the cross section of the pump chamber.

9. A dispensing pump according to claim 1, wherein the folded spring (9) is an accordion fold.

10. A dispensing pump according to claim 1, wherein the folded spring (9) is defined by a plurality of radius fold portions oriented in alternating oppositely opening directions.

11. A dispensing pump according to claim 1, wherein the folded spring 9 is defined by a plurality of substantially longitudinally disposed radius fold portions oriented in alternating oppositely opening directions.

* * * * *